US005636582A

United States Patent [19]

Ferguson et al.

[11] Patent Number: 5,636,582

[45] Date of Patent: Jun. 10, 1997

[54] FELL SEAMER DEVICE

[75] Inventors: Vivian Ferguson; Louis A. Tocchio, both of Mechanicsville, Va.

[73] Assignee: AMF Reece, Inc., Mechanicsville, Va.

[21] Appl. No.: 313,586

[22] Filed: Sep. 23, 1994

[51] Int. Cl.[6] ..... D05B 35/02

[52] U.S. Cl. ..... 112/142; 112/147; 112/153; 112/322; 112/475.03

[58] Field of Search ..... 112/141, 142, 112/147, 153, 322, 121.12, 475.03

[56] References Cited

U.S. PATENT DOCUMENTS

| | | | |
|---|---|---|---|
| 2,583,735 | 1/1952 | Hayes | 112/322 |
| 2,730,977 | 1/1956 | Hayes et al. | 112/322 |
| 3,525,310 | 8/1970 | Gensheimer | 112/142 |
| 3,811,391 | 5/1974 | Comforti | 112/147 |
| 3,889,614 | 6/1975 | Nicolay et al. | 112/153 |
| 3,948,195 | 4/1976 | Chudner | 112/322 |
| 4,395,963 | 8/1983 | Diacont, Jr. et al. | 112/142 |
| 4,476,792 | 10/1984 | Diacont, Jr. et al. | 112/142 X |
| 4,572,094 | 2/1986 | Taddicken | 112/322 |
| 4,573,420 | 3/1986 | Carson | 112/142 |
| 4,590,871 | 5/1986 | Granville | 112/142 |
| 4,653,414 | 3/1987 | Harrington | 112/142 |
| 4,714,036 | 12/1987 | Raisin et al. | 112/147 |
| 4,924,787 | 5/1990 | Hansberry | 112/142 |
| 4,941,417 | 7/1990 | Hansberry | 112/142 |
| 5,010,833 | 4/1991 | Spencer, III et al. | 112/262.1 |
| 5,031,552 | 7/1991 | Hansberry | 112/142 |
| 5,033,399 | 7/1991 | Miyachi et al. | 112/142 |
| 5,146,861 | 9/1992 | Sato et al. | 112/220 X |
| 5,222,450 | 6/1993 | Ackermann | 112/142 |
| 5,222,989 | 6/1993 | Hyca | 112/152 X |
| 5,235,923 | 8/1993 | Kojima et al. | 112/147 X |
| 5,289,788 | 3/1994 | Fukumoto | 112/121.12 |

OTHER PUBLICATIONS

Marcel Dekker, Inc., Handbook of Electric Motors, p. 543. 1995.

*Primary Examiner*—Ismael Izaguirre
*Attorney, Agent, or Firm*—James Creighton Wray

[57] ABSTRACT

The present invention relates to a semi-automatic device for sewing full felled inseams or outer seams on jeans. The fell seamer employs optical sensors and spline rolls to guide the material into and through the folder. Sensors are embedded in the folder of the device to indicate the amount of material to be introduced into the folder. A computer controlled interface indicates the adjustments to be made and automatically sends instructions to the machine to effect the adjustments. The full fell seamer device includes an upper cylinder assembly, an upper pivot assembly, an upper spline assembly, an upper flex shaft assembly, a lower cylinder assembly, a lower spline assembly, a folder assembly, an upper motor assembly, a lower flex shaft assembly, a control box assembly and a pneumatic assembly. The vision, logic and drive systems sense the material being fed and compute the information gathered and then effect the drive system functioning as required by the material to be sewn.

14 Claims, 4 Drawing Sheets

FELL SEAMER DEVICE

BACKGROUND OF THE INVENTION

This invention relates to semi-automatic full fell seamers for inseams or outseams, or any other full or half fell seams.

It is common knowledge that a full fell seam is one of the most difficult operations in jeans construction. Typically, this job requires a training curve of nine months to one year to reach peak production. Because it is so difficult to master, turnover in that job is higher than in most others. Fell seaming requires a higher degree of skill and dexterity. The constant finger and wrist motion can be a major cause of carpal tunnel or repetitive motion syndrome, a leading cause of workman's compensation claims. Full fell seams are also a major source of quality problems. "Washouts" occur when the operator has failed to push enough material into the folder during the sewing process. Unfortunately that happens far too frequently.

The felled seam operators are widely known to have one of the most difficult jobs in a jeans factory. Operators are required to perform physically challenging tasks as they guide the material into the folder. This skill requires long training time and can result in quality problems such as raw edges, washouts, twisted legs and wasted material, if not performed correctly. Even after the long and rigorous training cycle, the physical demands on the operators result in one of the highest percentage of workman's compensation claims in clothing factories.

The felled seam is one of the most complex and most physically demanding operations in producing a pair of jeans. Normally, the operator is required to constantly fold and steer material into the folder so that the seam is sewn by both needles. That requires a high degree of skill, and thus a high pay level.

The felled seam operation requires one of the highest skill levels, and also requires one of the longest training times. Typically, that operation can require training times up to one year to become fully productive. The importance of training time for this operation is also increased by the high rate of turnover of fell seam operators. In many plants, fell seam operator turnover is over twice as high as other operations, increasing costs and decreasing outputs.

As the operator sews the felled seam (inside or outside), he/she has a tendency to pull one ply in an attempt to assure that the ends of the panels match. That causes a twisted leg.

In sewing the felled seam, because of operator variations and inefficiency, raw edges can occur. In some cases, both panels are not completely folded in, so that the needles do not sew both pieces of material. The operator catches many of those by manually checking each pair. Raw edges lead to undoing the seam and resewing.

Many times, the operator does not find the problem and pressure from washing causes the seam to come undone, called a washout. The pair cannot be sold.

In many operations, to protect against raw edges and washouts the operator may overcompensate and fold in too much material. That may cause lumps, wrinkles or size variations. Those variations in leg size can vary from operator to operator.

The presser foot is normally controlled by a leaf spring and the feed roller is controlled by a compression spring. When crossing a seam, the thickness of the material can increase fourfold, increasing the pressure respectively. If the seam pressure under the presser foot is too high, the feed roller may be unable to pull the material through, resulting in a bog down. When stuck, the friction of the feed roller and feed dogs can wear through and damage the material.

During the sewing of the fell seam common quality issues are ripples or waves in the leg and the wariness in the material after the seam is sewn. The main reason for this is that the feed roller pressure needs to be set so high in order to limit the amount of bog downs. A secondary reason for the ripples is the variation in pressure on the material between the presser foot and feed dogs. That variation is caused by the small range of the leaf spring.

Ergonomics are important. Under normal conditions, the felled seam operator has constant stress on fingers and wrists from folding the material, as well as the neck and back from leaning forward over the folder during sewing. Repetitious movements are also required to inspect each garment for raw edges.

SUMMARY OF THE INVENTION

The present invention provides a semi-automatic device for sewing full felled inseams or outer seams on jeans. The new fell seamer addresses problems of long standing in the prior art by using optical sensors and spline rolls to guide the material into and through the folder, eliminating many of the demands on the operator.

The present invention provides a major technological breakthrough which substantially reduces problems in production.

The invention deskills operations. Training time is reduced from nine months to one year, to eight to ten weeks.

The new device reduces operator handling. Sensors control feed of material into the folder instead of operator fingers. Less fatigue and reduced hand motion reduce a leading cause of repetitive motion syndrome.

The new seamer improves quality and lowers repair costs. washouts are reduced, because the folder is always kept full of material.

The invention improves productivity. Operators' hands are free to push pockets out of seams and to handle panels.

The new device is a quick change folder that allows greater flexibility to handle a wide variety of fabrics.

The invention improves material utilization by reducing seam allowances required.

The new full fell seamer is a computer controlled interface that actually replaces the operators' fingers as the device for guiding material into the folder. Tiny sensors embedded in the folder tell the computer if more or less material needs to be introduced. The computer then instructs guides to make the necessary adjustments. All this is done automatically and instantly. The operator merely grasps the two panels of cloth and allows the machine feed to take over.

The system actually reads the edge of the fabric with each stitch, making adjustments as it sews. That ensures 100% accuracy and a flat even seam, for a cleaner appearance and a more saleable garment.

Because training time is drastically reduced, operator turnover is not a problem. Because the system is so easy to use, lower skilled operators can be employed.

Because the edges are so accurately controlled, seam allowances can be reduced. By making components narrower during marker making, more pieces can be placed across the width of the fabric. That allows the marker to be shortened, resulting in substantial material savings.

The present invention is a full fell seamer device which includes an upper cylinder assembly, an upper pivot assembly, an upper spline assembly, an upper flex shaft assembly, a lower cylinder assembly, a lower spline assembly, a folder assembly, an upper motor assembly, a lower flex shaft assembly, a control box assembly and a pneumatic assembly.

The new invention is a technological breakthrough in that it combines mechanical, optical and data processing systems into a relatively small, efficient package. The fell seaming machine may be divided into three different elements: the vision, logic and drive systems. The following is a brief description of how each element works together to produce the felled seam.

The vision system includes a network of fiber optic sensors located in the folder which interface with the logic system. The logic system is similar to those used in some micro surgical procedures. Infrared light beyond the red spectrum is produced by a scanner element and is input into the vision system, where edge sensing data is collected. That data is processed by the logic system for each ply of material, two times per stitch. At 4,000 RPM, data is collected and processed at a rate of 133 times per second. The logic system has a state-of-the-art board and uses CMOS logic and a DMOS power driver to perform those tasks.

The drive system has two servo-type motors connected to retractable spline shafts by way of flexible cables. The spline shafts are in a retracted position during loading and remain inactive until the material passes under the feed roller. During the sewing cycle the spline shafts replace the operators' hands and fingers, manipulating the fabric in the folder to produce perfect felled seams. On completion of the sewing cycle, the splines automatically return to the retracted position for loading the next garment.

In total, the three systems work together in the same manner that a human would. The eyes (vision system) send data signals to the brain (logic system), which interprets the data and instructs the hands (drive system) to respond accordingly. Thus, actual human interface to the sewing function and necessary skills are dramatically reduced, while quality is improved and job tasking flexibility is greatly increased.

The semi-automatic full fell seamer is particularly useful for inseams or outseams on 12 to 14 oz. denim. Other applications using denim or other materials in similar ways for sewing felled seams have been proven through testing.

The features and benefits of the new invention are many. Fiber optic edge sensors detect the amount of material in the seam as it flows through the folder. That area is not visible to the operator.

A specially designed folder incorporates spline shafts and edge sensors inches away from the sewing area.

A microprocessor controlled logic system integrates the optical sensors and spline shafts to control the amount of material that is folded into the seam.

A pneumatic pressure control for the presser foot and feed roller minimizes quality problems caused by variation of pressure on the material during normal sewing and when crossing seams.

In the present fell seamer, the requirements of the operator have been significantly reduced. The operator no longer has to continually feed material into the folder, the machine now controls this. The only skills required are at loading, the crotch seam and unloading. That aspect of the invention not only changes the base pay level, but also increases the base of employees who are capable of sewing the full fell seam.

At loading, the operator must position the material in the folder until 3 inches have been sewn. At this time the machine takes over. At the crotch, the operator may need to help the seams into the folder. The operator may also need to make sure that the crotch seams match up from outstitch to outstitch. At the end, the operator needs to guide the material for the final three inches, as the ends have passed the spline rolls.

Since an operator does not have to fully learn the skill of how to keep the folder full of material, his/her training time can be significantly reduced. Reductions in training time may exceed 50%.

By using pneumatic controls and decreasing the amount of pressure on the material, waves or ripples are reduced. The essentially constant pressure exerted by the air cylinders allows for a large reduction in the material waves.

The new full fell seamer significantly reduces or eliminates many of the ergonomic problems of the prior art, and decreases the risk of carpal tunnel syndrome. Details of specific movements with prior art fell seamers and with the new fell seamer are given below.

Before, an operator had to tilt his or her neck more than 30° 3 times per minute and hold that position for 10 seconds during the sewing to insure proper material feed. With the new device, the operator no longer needs to hold a contorted posture to insure proper material feed.

Before, an operator had to bend forward three times per minute and hold the forward bent position for 10 seconds during sewing. With the new device, the operator only must bend forward twice and is not required to hold the position.

Using preexisting seamers, a normal fell seamer operator required over 4 pounds of lateral pinch on the material, occurring between 9 and 30 times per minute and held for 10 seconds during controlled sewing. With this invention a fell seam operator is only required to pinch material approximately 6 times per minute.

Operators were required to bend wrists more than 20° 6 times per minute and hold for 5 seconds during controlled sewing. That was done to continually feed the garment. With the new device, that requirement is essentially eliminated.

The felled seamer only requires the operator to load the folder and guide the material. Fiber optic sensors sense the edge and control an even seam. By applying equal pressure in each panel throughout the seam, variations are eliminated. Spline adjustments can be made to apply more or less pressure to each panel and assure that the panel ends match after sewing. The felled seamer has a specially designed folder equipped with fiber optics to sense the edge of the material. The spline folds in the correct amount of material for the entire seam to assure the optimal amount of each panel in the seam.

With the present invention, variations in leg size, due to overcompensation by an operator in folding in too much material to protect against raw edges and washouts, are eliminated.

By using pneumatic cylinders, an essentially constant pressure is exerted on the material, regardless of thickness. That can minimize the risk of bog downs.

The fell seamer device enables an operator, after initially inserting the material, to lean back and guide the material loosely in a relaxed position while the machine continues the inserting. The new fell seamer automatically brings feed splines into position when the feed roller senses the presence of material, and automatically withdraws the feed splines when the feed roller senses the end of the material. The top feed spline is raised and lowered by a double acting air cylinder. The lower feed spline is rotated inward and outward by air driven plungers. Air cylinders lift and lower the presser foot and feed roller.

Spline driving servomotors are far removed from the folder. Long flexible shafts connect the splines and motors. Optical sensors sense the edges of the materials. The splines are driven intermittently as required in a single direction toward the folder. The edge sensors are built into a modified folder. Two thin L-shaped metal tubes with bent tips hold the optical fibers. The metal tubes are secured in grooves within an extension connected to the folder. The fiber optics transmit light to retro-reflectors in the folders and receive light when the retro-reflectors are uncovered. The edges are sensed twice for each stitch. Uncovering of the retro-reflectors causes the feed splines to rotate to press the material into the folder. Two small red pilot lights are visible to the operator. When the lights are off, the material is correctly inserted in the folder.

The feed roller and presser foot are lifted and lowered by double-acting air cylinders. When the work is completed, the feed roller and presser foot stay down. The splines move away from their wear plates automatically. The operator inserts the edges of material for a new pair of trousers into the folder and advances the material to the presser foot, while reaching into the space adjacent the folder. The operator touches a foot treadle to begin inward feeding of the material to the needle. The extinguishing of the red lights indicates that the material is present between the reflectors and the optical fibers. The operator pushes the seam material inward in the folder and pushes the material forward. When the seam reaches the feed roller, the feed roller is slightly lifted, which positions the splines against the material and begins the automatic inward feed. If a reflector is uncovered, the appropriate servo motor is driven, driving the spline for driving the material into the folder.

At the end of the stitching, the feed roller drop senses the end of the material. The upper spline and lower spline are lifted automatically and are swung away from the wear plates.

The upper drive spline has parallel circumferential grooves to present better driving edges.

The fell seamer device enables an operator, after initially inserting the material, to lean back and guide the material loosely in a relaxed position while the machine continues the inserting.

The new fell seamer automatically brings feed splines into position when the feed roller senses the presence of material, and automatically withdraws the feed splines when the feed roller senses the end of the material.

The top feed spline is raised and lowered by a double-acting cylinder. The lower feed spline is rotated inward and outward by air driven plunger. The top spline makes contact with the finished side of the top panel. The lower spline makes contact with the unfinished side of the bottom panel.

The top spline pressure on a single ply is controlled by spring pressure. The top spline pressure on a cross seam is controlled by air pressure. The bottom spline pressure on single ply and cross seam is controlled by air pressure.

Spline driving servomotors are far removed from the folder. Long flexible shafts connect the splines and motors. The top flexible shaft drives the top spline through a right angle gear box. The bottom flexible shaft directly drives the bottom spline. Optical sensors sense the edges of the materials. The splines are driven intermittently as required in a single direction toward the folder. Two fiber optic assemblies are secured in grooves within an extension connected to the folder. The fiber optics transmit light to retro-reflectors in the folders and receive light which is sensed when the retro-reflectors are uncovered. The edges are sensed twice for each stitch. Uncovering of the retro-reflectors causes the feed splines to rotate to press the material into the folder. Two small red pilot lights are visible to the operator. When the lights are off, the material is correctly inserted in the folder.

The presser foot and feed roller can be raised or lowered by double-acting cylinders. Pressure on material is controlled through pneumatic regulators.

A toe switch mounted on the foot treadle allows the operator to disable either or both spline feed motors by selecting the proper program on the control board.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
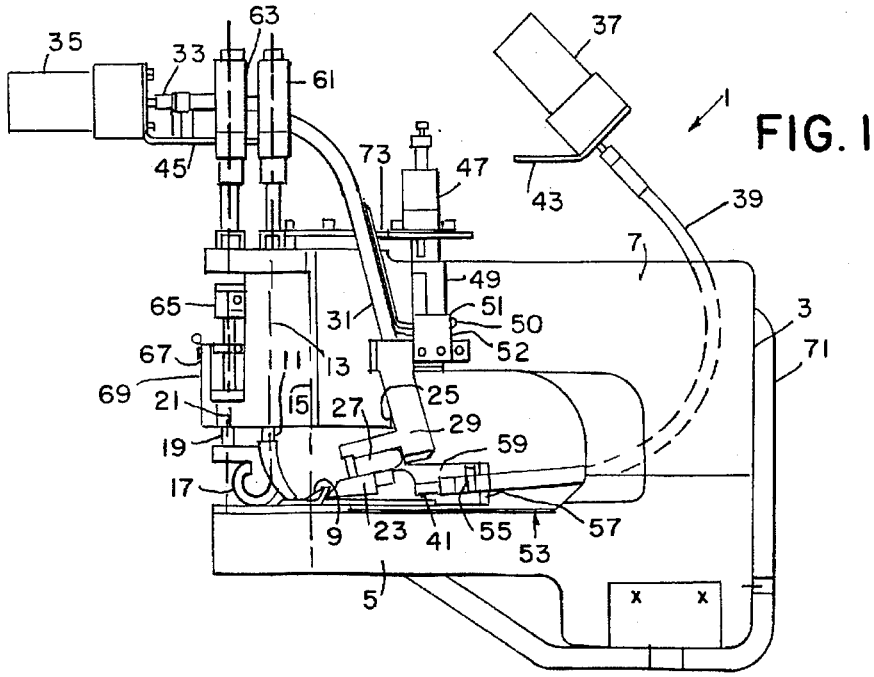
FIG. 1 is a front elevation of the fell seamer device on a sewing head.

Referring to FIG. 1, a commercial seam sewing machine head is generally indicated by the numeral 1. The machine has a frame connecting a base 5 and a head 7. The sewing machine head 7 has a presser foot 9 which moves vertically on rod 11 along axis 13. A needle (not shown) reciprocates vertically along axis 15. A feed roller 17 engages and drives the stitched seam intermittently while the needle is in an up position. The feed roller is mounted on rod, which reciprocates along axis 21. A folder assembly 23 folds the material, usually denim, to form the fell seam immediately upstream of the presser foot 9 and the needle axis 15. The presser foot 9 holds the seam while the needle stitches the seam. An upper drive assembly 25 has a spline 27 which is driven intermittently as required by a right-angled drive 29 at a distal end of a flexible shaft 31. The proximal end 33 of the shaft is connected to a servo motor 35, which drives the flexible shaft 31 upon command in a single direction to cause spline 27 to drive the upper denim layer into the folder 23. A second drive motor 37 and a second flexible shaft 39 directly drive spline 41, which contacts the inner unfinished surface of the lower denim material and drives the lower denim material inwardly into the folder 23 intermittently as required. Frames 43 and 45 mount the servo motors 37 and 35 at locations on the sewing machine or on a stand near the sewing machine which are remote from the material which is being folded and seamed.

An upper cylinder assembly 47 drives the spline assembly 25 up and down out of and into contact with the upper denim layer.

Two red lights 50 are mounted side by side on sloped surface 51 facing the operator to indicate when no material is sensed in the folder 23 or when the material is not fully inserted in the folder. One indicator light 50 is associated with the sensor for the upper material. The other indicator light 50 is connected to the sensor for the lower material.

An adapter block 49 and a threaded rod 6 control the up and down movement of the upper pivot assembly 52 to move the spline assembly 25 upward and downward.

Lower cylinder assembly 53 mounts the distal end of the flexible shaft 39 on a pivot 55. Pushing the end 57 around the pivot 55 brings the spline 41 into contact with the unfinished side of the lower material. Pushing outward on side 59 swings spline 41 out of contact with the material.

Presser foot rod 11 is connected to an air cylinder 61, which selectively raises and lowers the presser foot 9. Air cylinder 63 raises and lowers feed rollers 17. A sensor 65 senses when the feed roller 17 is lifted by a seam of material, and senses when the feed roller 17 drops at the end of the seam sewing cycle after the material has passed out from under the feed roller.

A sensor head 67 is mounted on a sensor bracket 69 to determine the position of the feed roller. A conduit 71 extends around the frame. A mounting plate 73 is positioned above the sewing machine head 7 to mount the air cylinder 47, which lifts and lowers the upper spline assembly 25.

Figure 2:
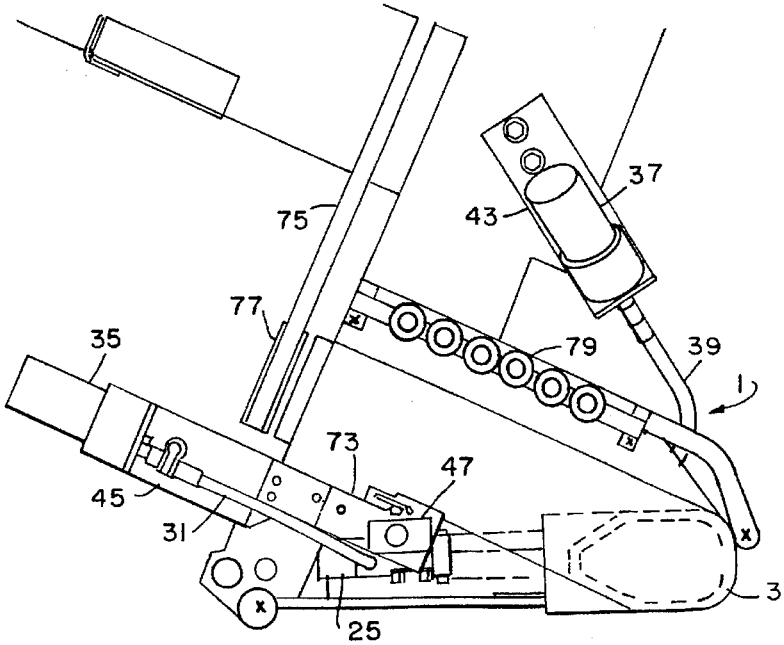
FIG. 2 if a top plan of the fell seamer device on a sewing head.

FIG. 2 shows that the sewing machine head 7 is canted. The main drive belt 75 and pulley 77 drive the sewing machine. Thread tension regulators 79 are mounted on a plate connected to the sewing machine head.

Figure 3:
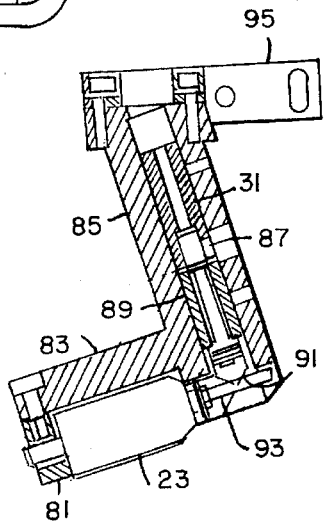
FIG. 3 is a front elevation of the upper spline assembly.

The upper spline assembly 25 is generally shown in FIG. 3. The drive spline 23 is mounted in a bearing 81 held in an extension 83 of the housing 85. The flexible drive shaft 31 is coupled 87 to drive shaft 89, which drives a miter gear 91 to drive the spline shaft 93. The entire assembly is mounted on an arm 95, which is connected to a mount 51 for providing the desired contact of the upper spline 23 with the finished surface of the upper denim material.

Figure 4:
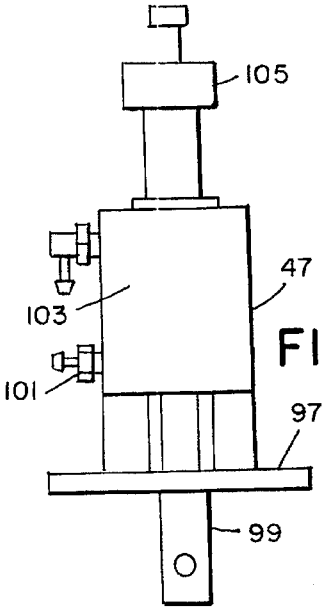
FIG. 4 is a front elevation of the cylinder assembly that lifts the upper spline assembly.

The upper cylinder assembly 47 shown in FIG. 4 is mounted on a plate 97, which is in turn mounted on plate 73 shown in FIG. 1. A connector 99 to a vertically movable shaft raises and lowers the spline assembly according to air supplied through fittings 101 and 103.

Figure 5:
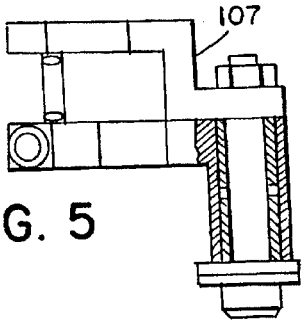
FIGS. 5 and 6 are a top plan and a front elevation of the upper pivot assembly.
Figure 6:
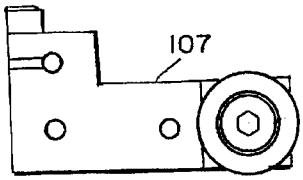

FIGS. 5 and 6 show the upper pivot assembly on which the spline assembly 25 shown in FIG. 1 is mounted.

Figure 7:
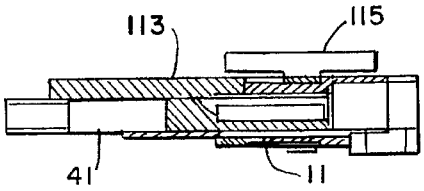
FIG. 7 is a top plan of the lower spline assembly.

FIG. 7 shows the lower spline assembly 111 which carries the lower spline 41 to contact the unfinished inner surface of the lower denim sheet. Housing 113 supports the spline, and pivot assembly 115 holds the spline housing 113.

Figure 8:
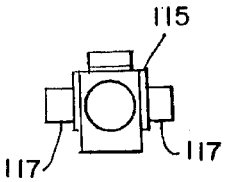
FIG. 8 is an end view of the lower spline assembly.

FIG. 8 schematically shows the pivot assembly 115, which supports the spline for pivoting about a generally vertical axis toward or away from the lower wear plate. Bearings 117 are oriented generally vertical when in position.

Figure 9:
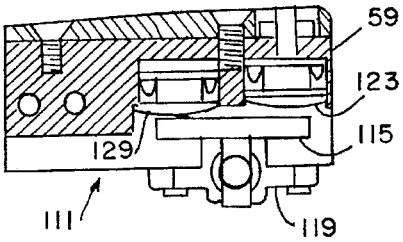
FIG. 9 is a top view of the lower cylinder and spline mount assembly.
Figure 10:
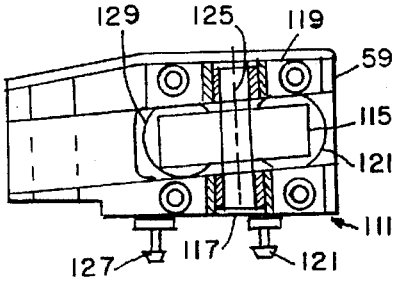
FIG. 10 is a front elevation of the lower cylinder and spline mount assembly.
Figure 11:
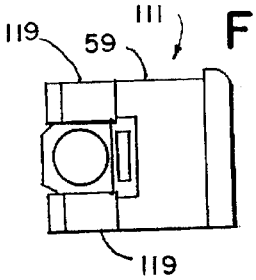
FIG. 11 is an end view of the lower cylinder and spline mount assembly.

FIGS. 9, 10 and 11 respectively show plan side and end views of the lower spline assembly 111. The pivot bearing carriers 119 are connected to the air cylinder housing 59 when air is supplied through fitting 121, piston 123 presses the spline assembly carrier 115 outward around axis 125, pressing the lower spline toward the associated wear plate. The denim material is squeezed between the lower spline and wear plate so that driving the lower spline advances the lower denim sheet into the folder. When air pressure is supplied to fitting 127, piston 129 presses plate 115 outward around axis 125, moving the lower spline assembly and the lower spline away from the wear plate and denim material.

FIGS. 12–15 are details of the folder and optical sensor assemblies.

Figure 12:
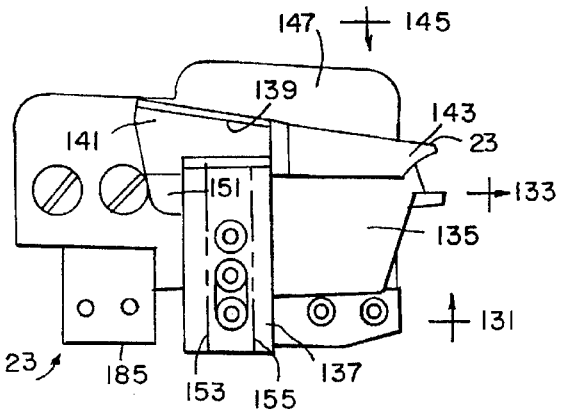
FIG. 12 is a top view of the sensor and the folder.

FIG. 12 is a plan view of a folder made according to the present invention.

Figure 13:
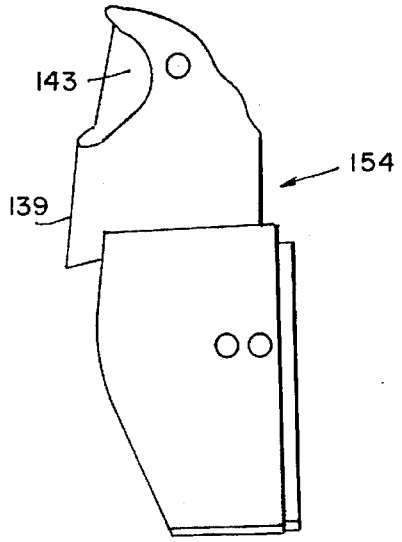
FIG. 13 is a top view of the sensor and the folder from which plates have been removed.

FIG. 13 is a plan view of a preferred folder from which a wear plate has been removed to expose the fiber optic guiding channels 154.

Figure 14:
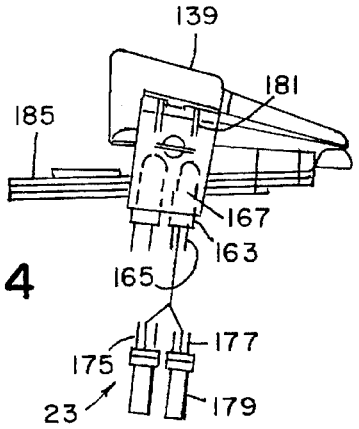
FIG. 14 is a side elevation of the sensor and the folder.

FIG. 14 is a side elevation of the folder showing the positioning of the heads of the fiber optic cables and schematically show the input and output ends of a cable.

Figure 15:
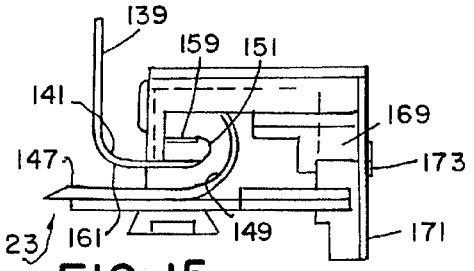
FIG. 15 is an end view of the sensor and the folder.

FIG. 15 shows the folder from the inward feeding end.

The finished inner surface of the upper layer of denim moves inward 131 and forward 133 along the wear plate 135 and the extension 137 of the wear plate, which covers the optical fibers.

The upper layer of denim contacts the wall 139 and folds inward over plate 141 and under the nose 143. The lower layer of denim moves inward 145 and forward 133 over the lower plate 147, and encounters wall 149 and folds inward above wall 151 while the inner edge of the upper layer of denim is folding inward below that wall 151.

To insure that the denim is properly fed into the folder, optical fibers 153 and 155 are positioned under plate 137. The optical fibers look down at retro-reflector tapes 159 and 161 positioned in the folders. The optical fibers 153 look at the reflector 159 and the optical fibers 155 look at the retro-reflector 161 to sense the edges of the bottom and top layers of fabric respectively. When no light is reflected, the materials are properly fed into the folder. Upon sensing any light, the appropriate spline motor is energized to drive the spline in the forward direction, advancing the top or bottom layer further into the folder in the direction of arrows 131 or 145. Head ends 163 of cables 165 are mounted in recesses 167 in a fiber optic base 169 beneath cover plate 171, which is held by a bolt 173. Each fiber optic cable 165 has two ends, 175 and 177, which terminate in couplers 179 for receiving a particular light input, such as a pulsed infrared input, and returning the reflective light to a photocell sensor. Each cable head end terminates in a fine rigid long U-shaped metal tube 181, which carries sufficient fibers to conduct light toward and away from the retro-reflectors. The tubes 181 extend upward from the head ends 163, and bend downwardly near their distal ends for transmitting and receiving light toward and from the retro-reflectors. The channels 183 in which the tubes are positioned are shown in FIG. 13, from which the plate 137 has been removed.

The folder assemblies are mounted on plates 185, which are bolted to the base of the sewing machine.

Figure 16:
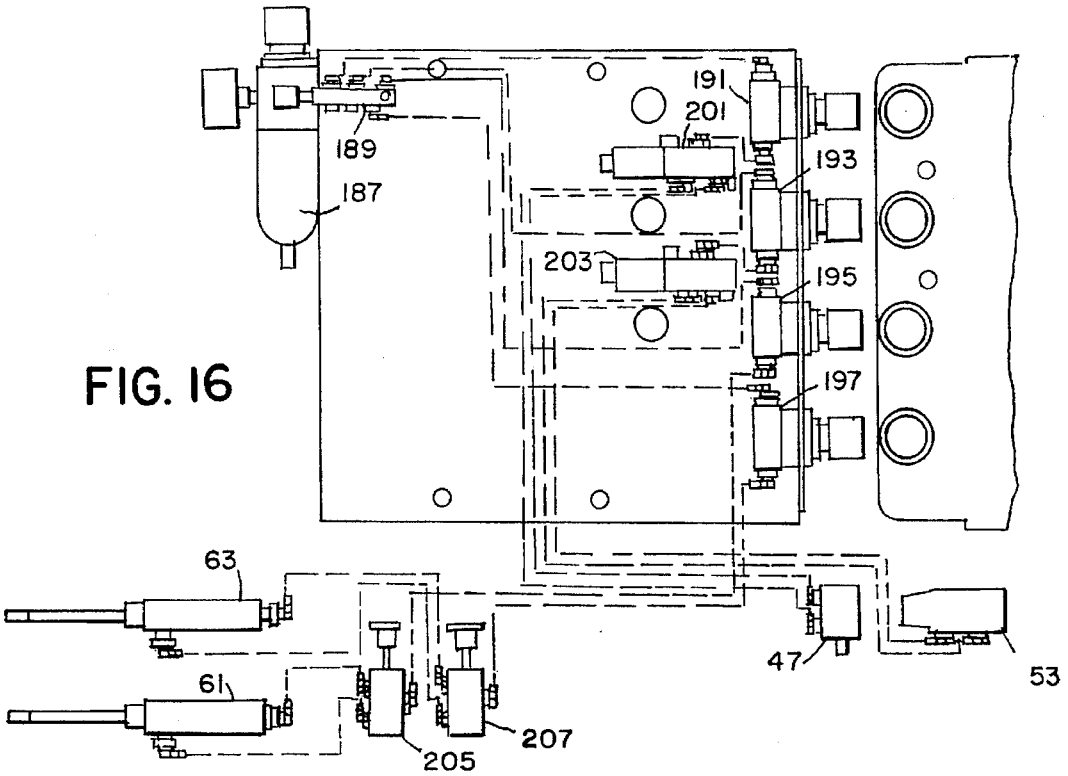
FIG. 16 is a schematic diagram of the pneumatic assembly.

FIG. 16 shows the air supply system air supplied from reservoir 187 through manifold 189 to regulators 191, 193, 195 and 197. Regulator 191 supplies air to the upper spline belt 201, which controls the air supply to the upper spline cylinder 47. Regulator 193 supplies air to the roller spline valve 203, which controls air to the lower spline cylinder 53. Regulator 195 supplies air to the presser foot valve 205, which controls air for the presser foot cylinder 61. Regulator 197 supplies air to feed roller valve 207, which controls the feed roller cylinder 63.

Figure 17:
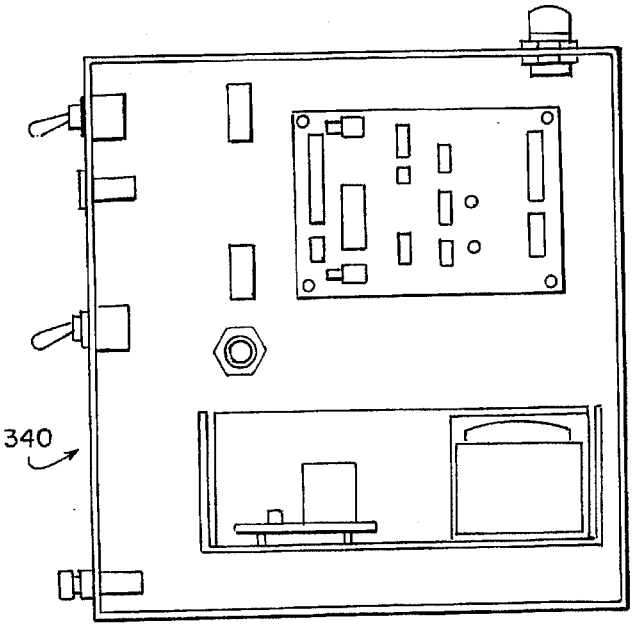
FIG. 17 is a schematic diagram of the control box assembly.

FIG. 17 shows the control box assembly 340.

Figure 18:
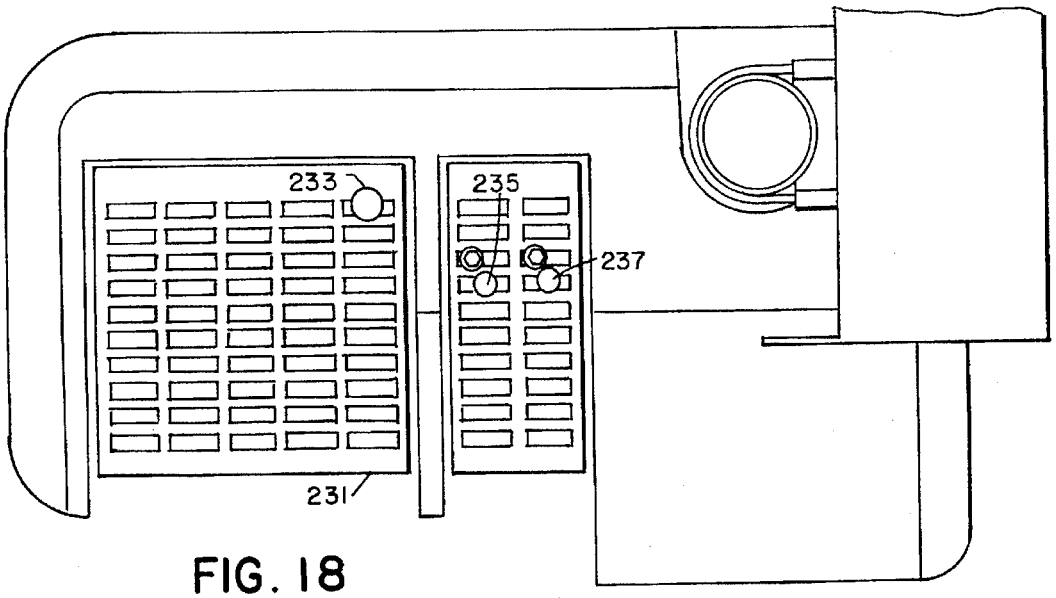
FIG. 18 is a plan view of preferred foot switches.

FIG. 18 shows the foot controls in which the main treadle 231 is rocked for beginning the sewing operation. A toe operated switch 233 on the treadle provides air to all of the cylinders to move the splines away from their wear plate and to lift the feed roller and presser foot. Foot operated switches 235 and 237 are used to selectively provide air to the cylinders.

Figure 20:
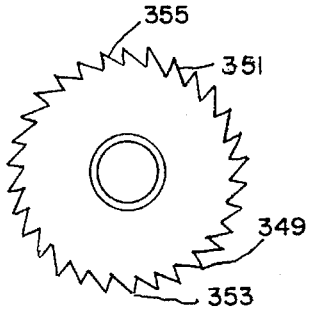
FIG. 20 is an end view detail of a preferred upper spline.
Figure 19:
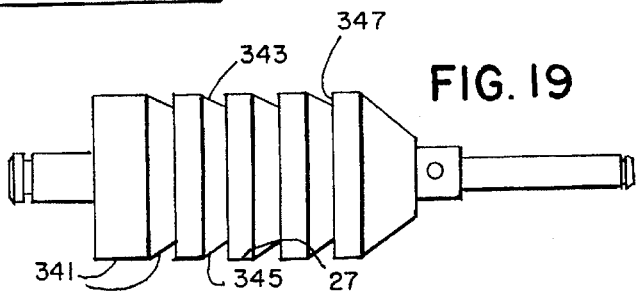
FIG. 19 is a detail of a preferred upper spline.

FIGS. 19 and 20 show a preferred shape of the upper spline 27. The spline is divided into individual sections 341 by grooves 343, which are tapered 345 at the leading edge and perpendicular 347 at the rearward edge. The teeth 349 are formed by equally spaced slots 351, with radial surfaces 353 and sloped surfaces 355 in the direction of rotation. The unique tooth shape and dividing of the sections by grooves provides multiple tooth corners for positively driving the denim fabric.

While the invention has been described with reference to specific embodiments, modifications and variations of the invention may be constructed without departing from the scope of the invention, which is defined in the following claims.

We claim:

1. A fell seamer device comprising a folder, upper and lower splines, the folder having an outward facing inner wear plate against which a lower material is pressed by the lower spline, the folder having an upper wear plate against which material is pressed by the upper spline, a first flexible connector connected to the upper spline for driving the upper spline, and a first servomotor connected to the flexible connector for driving the first flexible connector, a second flexible connector connected to the lower spline for driving the lower spline, and a second servomotor connected to the second flexible connector for driving the second flexible connector, wherein the upper spline is mounted on an upper spline assembly, and wherein the upper spline assembly is connected to a vertically reciprocal rod, and further comprising an upper spline actuator connected to the rod for lifting and lowering the rod, the upper spline assembly and the upper spline out of and into contact with the upper spline wear plate.

2. The apparatus of claim 1, wherein the upper spline has plural teeth with radial forward faces and sloped rearward faces.

3. The apparatus of claim 2, wherein the spline has spaced circumferential grooves separating the teeth into axially spaced cylindrical arrays of teeth.

4. A fell seamer device comprising a folder, upper and lower splines, the folder having an outward facing inner wear plate against which a lower material is pressed by the lower spline, the folder having an upper wear plate against which material is pressed by the upper spline, a first flexible connector connected to the upper spline for driving the upper spline, and a first servomotor connected to the flexible connector for driving the first flexible connector, a second flexible connector connected to the lower spline for driving the lower spline, and a second servomotor connected to the second flexible connector for driving the second flexible connector, wherein the lower spline is connected to a pivot assembly, and wherein the pivot assembly is connected to a housing having first and second actuators, the first actuator moving the spline about the pivot assembly and into engagement with the lower wear plate, and the second actuator moving the spline about the pivot assembly away from the second wear plate.

5. The apparatus of claim 4, wherein the first and second lower spline actuators are first and second lower spline air cylinders.

6. The apparatus of claim 5, further comprising an upper material guide plate mounted on top of the lower spline air cylinders for guiding an upper material to the upper wear plate.

7. A fell seamer device comprising a folder, upper and lower splines, the folder having an outward facing inner wear plate against which a lower material is pressed by the lower spline, the folder having an upper wear plate against which material is pressed by the upper spline, a first flexible connector connected to the upper spline for driving the upper spline, and a first servomotor connected to the flexible connector for driving the first flexible connector, a second flexible connector connected to the lower spline for driving the lower spline, and a second servomotor connected to the second flexible connector for driving the second flexible connector, further comprising an upper spline air cylinder for lifting and lowering the upper spline out of and into contact with the upper wear plate, first and second lower spline air cylinders for pivoting the lower spline into and out of operational relationship with the lower wear, and further comprising a presser foot mounted adjacent an outlet of the folder for pressing folded material against a machine platen, the presser foot being mounted on a presser foot assembly connected to a lower end of a presser foot rod and a double acting presser foot air cylinder connected to an upper end of the presser foot rod for raising the presser foot, a feed roller positioned adjacent the presser foot for driving folded and sewn material, the feed roller connected to a feed roller assembly, and a feed roller reciprocal rod having a lower end connected to the feed roller assembly, and a feed roller air cylinder connected to the feed roller rod for raising and lowering the feed roller, a sensor bracket mounted adjacent the feed roller rod for sensing position of the feed roller rod and thereby sensing presence or absence of a folded and sewn seam beneath the feed roller rod.

8. A fell seamer device comprising a folder, upper and lower splines, the folder having an outward facing inner wear plate against which a lower material is pressed by the lower spline, the folder having an upper wear plate against which material is pressed by the upper spline, a first flexible connector connected to the upper spline for driving the upper spline, and a first servomotor connected to the flexible connector for driving the first flexible connector, a second flexible connector connected to the lower spline for driving the lower spline, and a second servomotor connected to the second flexible connector for driving the second flexible connector, wherein the folder has a curved channel for receiving and folding an edge portion of an upper material, and wherein the folder has a lower channel interpositioned with respect to the upper channel for receiving and folding an edge portion of a lower material, and further comprising first and second optical fiber assemblies mounted in the folder beneath the upper wear plate and terminating in the folder opposite the first and second reflectors respectively for directing light to the respective reflectors and receiving light from the respective reflectors when edge portions of the reflective upper and lower materials are not covering the reflectors.

9. The apparatus of claim 8, wherein each fiber optic assembly has plural optical fibers mounted within a cable having distal and proximal ends, wherein the multiple fibers extend from the distal end of the cable through a fine tube having a proximal end connected to the distal end of the cable, and having a distal end bent in the direction of the reflector, and wherein the flexible ends of some of the fibers are connected to a light source and proximal ends of other of the fibers are connected to a light sensor.

10. The apparatus of claim 9, wherein distal ends of the fiber optic cables are mounted in recesses beneath a side plate of the folder.

11. The apparatus of claim 10, herein the fine tubes are mounted in channels beneath the upper wear plate of the folder.

12. The method of operating a fell seamer, comprising introducing upper and lower layers of material into a folder, folding the material into a felled seam in the folder, placing the folded seam under a presser foot and sewing the same, and advancing the sewn seam intermediately between sequential stitches with a feed roller, driving edge portions of the upper and lower materials into the folder unidirectionally with upper and lower splines, and driving the upper and lower splines with elongated flexible cables connected to motors remotely spaced from the folder, further comprising projecting light into first and second channels in the folder from optical fibers in thin tubes, reflecting light from first and second channels in the folder with reflectors in the first and second channels when the reflectors are not covered by edge portions of the upper and lower materials, receiving the reflected light through optical fibers in the tubes, sensing reflected light from the optical fibers, and controlling operation of the motors for driving the splines through the flexible cables upon sensing reflected light in respective optical fibers.

13. The method of claim 12, further comprising lifting an upper spline assembly away from an upper wear plate with an upper spline air cylinder, pivoting a lower spline assembly away from a lower wear plate with a first lower spline air cylinder, lifting a presser foot with a presser foot air cylinder, and lifting a feed roller with a feed roller air cylinder upon sensing a dropping of a feed roller, indicating the end of the seamed material passing under the feed roller.

14. The method of claim 13, further comprising urging upper and lower material layers into the folder, lowering the feed roller with the upper spline with the upper spline air cylinder, swinging the lower spline inward to press the lower material against the lower wear plate with a second lower air cylinder, lowering the presser foot with the presser foot air cylinder, and lowering the feed roller with the feed roller air cylinder, and continuing operation of the seamer.

* * * * *